US005321424A

United States Patent [19]

Alelyunas

[11] Patent Number: 5,321,424

[45] Date of Patent: Jun. 14, 1994

[54] ADAPTIVE GRATICULE

[75] Inventor: Carl Alelyunas, Beaverton, Oreg.

[73] Assignee: Magni Systems, Inc., Beaverton, Oreg.

[21] Appl. No.: 989,983

[22] Filed: Dec. 11, 1992

Related U.S. Application Data

[63] Continuation of Ser. No. 679,610, Apr. 3, 1991, abandoned.

[51] Int. Cl.[5] ..... G09G 1/28

[52] U.S. Cl. ..... 345/199; 345/186

[58] Field of Search ..... 340/722, 799, 703, 721; 324/121 R, 88

[56] References Cited

U.S. PATENT DOCUMENTS

| | | | |
|---|---|---|---|
| 3,958,269 | 3/1976 | Davis | 324/88 |
| 4,105,932 | 8/1978 | Cleary, Jr., et al. | 324/88 |
| 4,145,706 | 3/1979 | Hess et al. | 324/88 |
| 4,399,512 | 8/1983 | Soma et al. | 340/722 |
| 4,484,187 | 11/1984 | Brown et al. | 340/721 |
| 4,764,721 | 8/1988 | Slavin | 324/121 R |
| 4,772,881 | 9/1988 | Hannah | 340/703 |
| 4,868,496 | 9/1989 | Havel | 324/121 R |
| 4,868,552 | 9/1989 | Chang | 324/121 R |
| 4,878,194 | 10/1989 | Nakatsugawa et al. | 340/722 |
| 5,068,650 | 11/1991 | Fernandez et al. | 340/799 |

FOREIGN PATENT DOCUMENTS 2183420 10/1989 United Kingdom .

*Primary Examiner*—Alvin E. Oberley
*Assistant Examiner*—Gin Goon
*Attorney, Agent, or Firm*—Heller, Ehrman, White & McAuliffe

[57] ABSTRACT

A graticule display processor that can produce an adaptive graticule for a raster-scan output waveform monitor. The graticule may be displayed in front of the waveform, behind the waveform or mixed with the waveform. The graticule can change the waveform's color or intensity in specific regions, thereby enhancing the appearance of over range conditions. A specific use is to allow the vector functions of phase and gain to be monitored in the waveform mode.

19 Claims, 2 Drawing Sheets

ADAPTIVE GRATICULE

This is a continuation of application Ser. No. 07/679,610 filed Apr. 3, 1991, now abandoned.

BACKGROUND OF THE INVENTION

The present invention relates to a raster scan video display of a waveform or vector with associated graticules. Prior art has a graticule displayed at only one intensity level, which is always displayed without regard to the waveform or vector position or intensity. In that case, the graticule can mask or distort the viewed waveform. It would be very desirable therefore to provide a graticule which changes color or intensity depending on the waveform or vector display status.

SUMMARY OF THE INVENTION

It is an object of the present invention to provide an improved graticule display for waveform monitors or vectorscopes.

It is another object of the present invention to provide an improved graticule display for monitors or vectorscopes which are implemented as raster-scan video.

In one preferred embodiment, a graticule is generated as a pattern of dedicated bits in the display memory by a microprocessor. These dedicated bits choose a page stored in a look-up table memory which changes the waveform or vector color or intensity from its nominal or initial value. By choosing the proper values in the look-up table, the graticule may appear to be in front of the waveform, behind the waveform, or mixed with the waveform. Zones of the waveform display can be caused to change color or intensity.

Other objects, features and advantages of the present invention will become apparent from the following detailed description when taken in conjunction with the accompanying drawings.

BRIEF DESCRIPTION OF THE DRAWINGS

The accompanying drawings which are incorporated in and form a part of this specification illustrate an embodiment of the invention, and together with the following detailed description, serve to explain the principles of the present invention.

DETAILED DESCRIPTION OF THE INVENTION

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, it is intended to cover alternatives, modifications and equivalents as may be included within the spirit and scope of the invention as defined by the appended claims.

Figure 1:
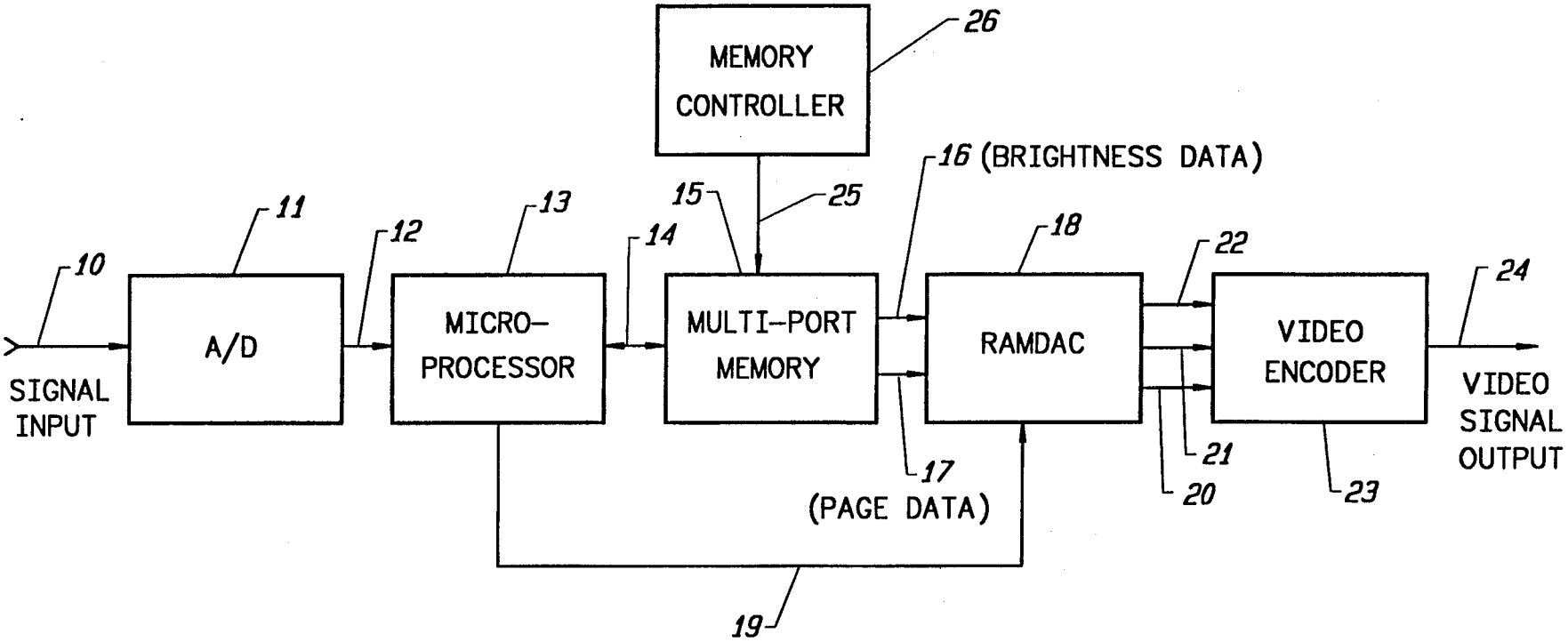
FIG. 1 depicts a system block diagram of the adaptive graticule system according to the present invention.

Referring to FIG. 1, a System Block Diagram of the present invention is depicted.

In FIG. 1, an input analog signal 10 is digitized by the analog to digital converter (A/D) 11, creating the input digital signal 12.

The multiport memory 15 is organized as rows and columns of memory locations. Each memory location includes some number of bits describing brightness and some number of bits to be used as page control for the RAMDAC 18.

The input digital signal 12 is used by the microprocessor 13 to generate the memory interface 14 in such a way that:

A. Column address or horizontal information is derived from the signal timing. This is equivalent to the horizontal sweep in an oscilloscope. This timing information is extracted mathematically from the input digital signal 12 by the microprocessor 13

B. Row address or vertical information is derived from the input digital signal 12 by the microprocessor 13. This is equivalent to the vertical amplifier of an oscilloscope.

C. Brightness and page control which comprise the information contained in the multiport memory 15 are created by the microprocessor 13.

The column address, row address and data comprise the memory interface 14.

The memory controller 26 of FIG. 1 generates the memory timing signals 25 necessary for the multiport memory 15. The memory timing 25 causes the brightness data 16 and the page data 17 to be output from the multiport memory sequential by row and column. This pattern of data is arranged so that when the brightness information is converted to a video signal and displayed on a picture monitor, the row information corresponds to the horizontal scan line, and column information corresponds to the position of the brightness spot on the horizontal line.

The RAMDAC 18 is arranged as three blocks of memory, whose contents are loaded by the microprocessor 13 through interface 19. The addresses of the memory blocks are connected to the page data 17 and the brightness data 16. This performs a re-mapping of any binary number input to any binary output as a look-up table function, with the microprocessor 13 having control of the contents of the look-up table. Page data 17 chooses between multiple palettes in the memory block. The output of each memory block in a RAMDAC is internally connected to a digital to analog converter (DAC). The outputs of the three digital to analog converters correspond to the three primary colors. The first color signal 20, the second color signal 21, and the third color signal 22 are converted into the color encoded video signal output 24 by the video encoder 23.

The organization of the data from the multiport memory 15 into page data 17 and brightness data 16 allows many enhancements to the display of scale information with waveform information.

The waveform may be displayed in such a way as to appear in front of the scale, or graticule. This is done by the microprocessor 13 creating the scale as a row and column pattern of page data 17 bits in the multiport memory 15 to select different palettes within the RAMDAC 18. If the palettes, which are selected by the page data 17, are set so that a brightness level of zero corresponds to the graticule color, and otherwise all palettes are the same, the waveform will appear to be in front of the graticule.

By changing the some palettes to be constant with any input brightness level, selecting those palettes with graticule position will make the waveform appear behind the graticule. Other palette maps can be created to cause the waveform to appear to be mixed with the graticule.

The waveform color may be set to change in different regions of the display. The microprocessor 13 creates the palettes in the RAMDAC 18 and the regions of page data 17 in the multiport memory 15 which selects palettes. The waveform appears as brightness data 16. As a waveform passes through one region to another, the palette changes. This palette change results in a color or intensity change when the video signal output 24 is viewed on a picture monitor. A specific example is the use of regions or color change to set limits on waveform excursion, which may be easily seen.

Figure 2:
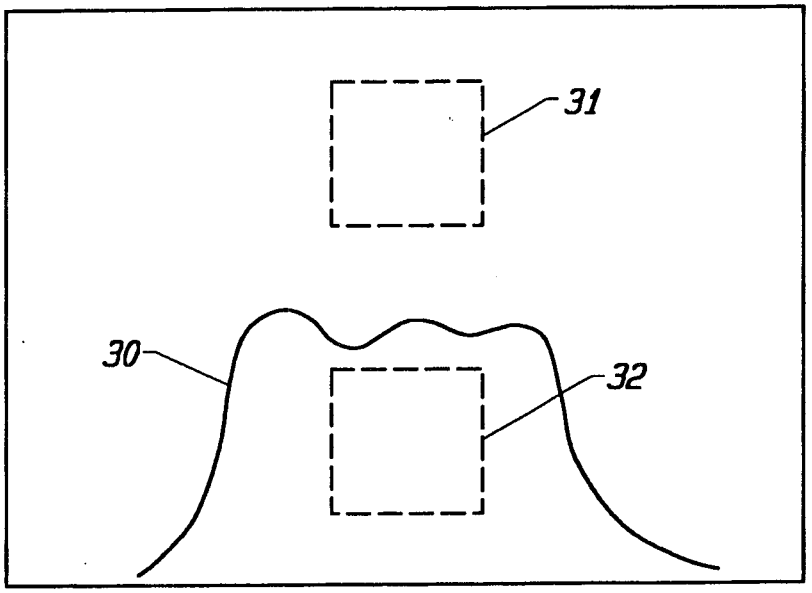
FIG. 2 depicts one possible use of the adaptive graticule system of the present invention, showing color change limits on a waveform display.

FIG. 2 illustrates color change Limits on a waveform display. In FIG. 2, the appearance of a raster-scanned picture monitor with a waveform 30, is shown as it would be output from the present invention. Region 31 corresponds to a region where, if waveform 30 passed through, the color would change, indicating an overvoltage condition on the signal input to the present invention. Region 32 corresponds to an undervoltage region. In three color component television signals, overvoltage and undervoltage conditions at specific times on a color-bar test signal waveform indicate color phase and gain error, thus color phase and gain may be monitored by the appearance of the waveform color in the present invention.

It should be pointed out that the various control functions of microprocessor 13 as described in conjunction with FIGS. 1 and 2 can be implemented with suitable programming techniques by one of ordinary skill in the art.

one feature of the present invention is the use of special bits in the display memory to select pages of a color look-up table. By setting the special bit array in the graticule positions, and remapping the look-up table, the waveform can be set to appear in front of, behind, or mixed with the graticule, depending on look-up table contents An inherent advantage of the look-up table is the ability to select virtually any color for the waveform or graticule independently. Setting graticule bits in whole regions of memory will allow waveform color or intensity to change as the graticule bits select different look-up table pages as the waveform passes through those regions.

The foregoing description of the preferred embodiment of the present invention has been presented for purposes of illustration and description. IT is not intended to be exhaustive or to limit the invention to the precise form disclosed, and many modifications and variations are possible in light of the above teaching. The preferred embodiment was chosen and described in order to best explain the principles of the invention and its practical applications to thereby enable others skilled in the art to best utilize modifications as are suited to the particular use contemplated. It is intended that the scope of the present invention be defined only by the claims appended hereto.

What is claimed is:

1. A raster displayed waveform monitor comprising:

a random access memory, including three memory blocks;

each of said memory blocks including a different color look-up table representative of a different primary color;

each of said color look-up tables including a plurality of memory pages representing different palettes within each color look-up table;

a multi-port memory;

means for storing a digitized waveform representative of an input signal to said multi-port memory;

said multi-port memory organized as rows and columns of memory locations for storing digitized brightness information representative of the shape, intensity, and color palette address of a waveform representative of said input signal and of a raster scanned graticule, and for storing digitized page control information indicating which of said color palettes will be addressed by said brightness information;

said color look-up tables responsive to said brightness information and said page control information to allow for coloring both said waveform and said graticule and to provide a digital output representative of the shape, intensity, and color of said waveform and said raster scanned graticule;

a digital to analog converter for converting said digital output into analog component video signals in each of the primary colors, representative of the shape, intensity, and color of said waveform and said raster scanned graticule;

said multi-port memory including memory control means for causing said brightness information and page control information to be output from said multi-port memory sequentially by row and column, the information contained in each said row corresponding to a horizontal scan line and the information in each said column corresponding to the position of a spot on said horizontal scan line;

means for displaying said waveform and said graticule on said monitor; and control means for controlling the display of said raster scanned graticule on said monitor such that said graticule can appear to be displayed to a viewer behind, in front of or mixed with said waveform.

2. A monitor as in claim 1 wherein said control means include microprocessor means.

3. A monitor as in claim 1 further including means for receiving said input signal, and wherein said multi-port memory includes means for storing said waveform representative of said input signal and said graticule to allow accurate matching of the timing of said input signal to said graticule such that said graticule is changed as a function of said changes in said input signal.

4. The monitor as in claim 3 wherein the change in said graticule is the color of said graticule derived from the amplitude of said input signal.

5. A monitor as in claim 3 wherein the change in said graticule is the addition of limit information when said input signal is near a predetermined limit.

6. A monitor as in claim 3 wherein said change in said graticule is the addition of limit boxes as said input signal is near said predetermined limit.

7. The monitor as in claim 3 including analog to digital converter means for converting said input signal to a digital signal.

8. The monitor as in claim 7 wherein said processor means generates column address or horizontal information signals from said digital signals corresponding to the horizontal sweep in said monitor.

9. The monitor as in claim 8 wherein said processor means generates row address or vertical information signals from said digital signals corresponding to the vertical amplifier in said monitor.

10. The monitor as in claim 8 wherein said processor means generates brightness and page control signals from said digital signals.

11. A monitor as in claim 1 including means for representing vector functions of phase and gain representative of said waveform display.

12. The monitor of claim 11 wherein said vector functions of phase and gain are in limits blocks on said waveform.

13. The monitor as in claim 1 wherein said processor means includes means for selecting different palettes within said random access memory.

14. The monitor as in claim 13 wherein the selected palettes are set so that a brightness level of zero corresponds to the graticule color such that said waveform appears to be in front of said graticule.

15. The monitor of claim 13 wherein the selected palettes are changed to be constant with the input brightness level such that the selection of said palettes with graticule position will make said waveform to appear behind said graticule.

16. The monitor as in claim 13 wherein the selected palettes cause said waveform to appear to be mixed with said graticule.

17. The monitor as in claim 13 wherein said processor means includes means for changing the color of said waveform in different regions of said display in response to said input signals.

18. The monitor as in claim 17 including means for creating said palettes and the regions of page control information in said multi-port memory which selects palettes so that when said waveform passes from one region to another, a different palette is selected.

19. The monitor as in claim 18 wherein color changes in the different regions indicate overvoltage or undervoltage conditions so that with three color component television signals, said overvoltage and undervoltage conditions at specific times on a color-bar test signal indicate color phase and gain error so that color phase and gain may be monitored by the appearance of the waveform color on said monitor.

* * * * *